United States Patent [19]
Ambler

[11] 4,285,686
[45] Aug. 25, 1981

[54] V-BOARD FOLDER FOR FLEXIBLE PLASTIC FILMS

[75] Inventor: James R. Ambler, Seekonk, Mass.

[73] Assignee: Gloucester Engineering Co., Inc., Gloucester, Mass.

[21] Appl. No.: 82,091

[22] Filed: Oct. 5, 1979

[51] Int. Cl.[3] ..... B31B 1/36
[52] U.S. Cl. ..... 493/439; 493/447; 493/476
[58] Field of Search ..... 93/20, 14, 17–19, 93/84 TW, 84 R; 493/439, 248, 436, 438, 455, 447, 476

[56] References Cited

U.S. PATENT DOCUMENTS

| | | | |
|---|---|---|---|
| 518,242 | 4/1894 | Goss | 93/20 X |
| 2,961,932 | 11/1960 | Francis et al. | 95/1.7 |
| 3,059,549 | 10/1962 | Seiden | 93/20 |
| 3,351,339 | 11/1967 | Beard et al. | 270/94 |
| 3,485,145 | 12/1969 | Jones | 93/20 |
| 3,486,424 | 12/1969 | Tanner | 93/20 X |
| 3,545,347 | 12/1970 | Sylvester et al. | 93/84 R |
| 3,566,756 | 3/1971 | Schmid et al. | 93/20 X |
| 3,962,958 | 6/1976 | Hobart | 93/20 |
| 4,016,808 | 4/1977 | Young | 93/62 |

FOREIGN PATENT DOCUMENTS

| | | | |
|---|---|---|---|
| 810849 | 3/1959 | United Kingdom | 93/20 |

*Primary Examiner*—James F. Coan
*Attorney, Agent, or Firm*—Orrin M. Haugen; Thomas J. Nikolai

[57] ABSTRACT

Sheet folding means comprising a triangular frame structure having an apex over which a web of sheet material is passed for forming one or more folds therein, with a single fold forming a multi-ply web from a single web, and with multiple folds forming gussets within the web. In the device, continuous linear surfaces are provided for both defining the fold, and ultimately preserving the fold in the film moving across the folder structure. The folder includes a pair of mutually convergent arm members which converge toward an apex point adjacent to tip ends of the convergent arm members. First and second tip plates are provided for mounting upon the first and second converging arms respectively, with the tip plates each being polygons with linear edges, and being dimensioned so as to span the space between the converging arm means to form a selected apex point with the apex point being projected outwardly from the tip ends of the convergent arm members. When gussets are being formed, a gusset forming member having a pair of converging surfaces forming an apex is secured to the frame means and is adjustably disposed with the apex of the gusset forming member being positioned generally between the edges of the first and second tip plates and the projected apex of the converging arm members.

4 Claims, 13 Drawing Figures

V-BOARD FOLDER FOR FLEXIBLE PLASTIC FILMS

BACKGROUND OF THE INVENTION

The present invention relates generally to an improved sheet folding apparatus, and more particularly to an adjustable sheet folder which is provided with linear surfaces for defining the fold zones or lines in the film, with the structure having the capability to accommodate formation of either single or multiple folds at a predetermined lateral position along the web. Sheet folders of the present invention are particularly adapted for use in combination with bag making machines and the like wherein the converter may utilize the machine for preparation of a variety of bag styles from time-to-time depending upon demand. Bag making machines are, of course, well known with such apparatus being disclosed and claimed in U.S. Pat. Nos. 2,947,345, 3,043,532 and 3,059,549.

In a normal converting operation, the machine operator may be charged with the responsibility of producing bags of differing styles, depending upon the demand for finished bag product. In certain instances, a single machine may be called upon to produce bags with and without gussets, with the bag making machine being utilized for the selected production, and with equipment being changed from time-to-time to accommodate the preparation of bags of differing shapes, styles and configurations. As such, a folder, in order to be universally acceptable, is desirably provided with means to modify the configurations so as to provide a single fold, or a tucked-in portion to ultimately form gussets in the finished bag product. Folders are, of course, well known in the art and are widely used in the film converting industry.

SUMMARY OF THE INVENTION

In accordance with the present invention, a sheet folder is provided which utilizes a pair of mutually convergent arm members each of which converge toward an apex adjacent the tip ends thereof. First and second tip plates are provided for mounting upon the convergent arm members, with these tip plates each being polygons with linear edges. The dimensions of the linear edges are such that one or more tip plates span the space between the converging arm members at the tips of the arms to form a selected apex point. Normally, the apex is projected at a predetermined distance outwardly from the converging arm members, and the distance between the ends of the arms and the projected apex point will determine the extent or length of the gusset. The tip plates are designed such that in one preselected disposition, no gusset is formed, with the tip plates in turn forming the apex point.

In addition to the mutually convergent arm members and their associated tip plates, a gusset forming member is provided which itself has a pair of converging edge surfaces forming an apex. The gusset forming member is adjustably positioned relative to the mutually convergent arm members, with the gusset forming member, when utilized, being disposed in that zone between the edge of the tip plates and the projected apex point of the mutually convergent arm members. For most applications with thermoplastic film, such as polyethylene film, it is desirable to coat the film contacting surfaces with a relatively thin layer of polytetrafluoroethylene to reduce the friction between the film surface and the folder surface.

Therefore, it is a primary object of the present invention to provide an improved sheet folding apparatus which utilizes a pair of mutually convergent arm members with linear surfaces being provided to define fold lines in a moving web, and with first and second tip plates being adapted for selective mounting upon the arms to form a desired apex point between the mutually convergent arm members.

It is a further object of the present invention to provide a sheet folding apparatus which is substantially universally adaptable for use with folding film product, and which may be utilized to form either single or multiple folds on the film, such as providing a film web with a fold point, with the fold point being optionally provided with an inwardly folded gusset.

Other and further objects of the present invention will become apparent to those skilled in the art upon a study of the following specification, appended claims and accompanying drawings.

IN THE DRAWING

FIG. 1 in a perspective view of a sheet folder means in accordance with the present invention, and with the folder being shown in actual use with a web of sheet material passing thereover in operative relationship, and ultimately onto a converter apparatus;

Figure 11:
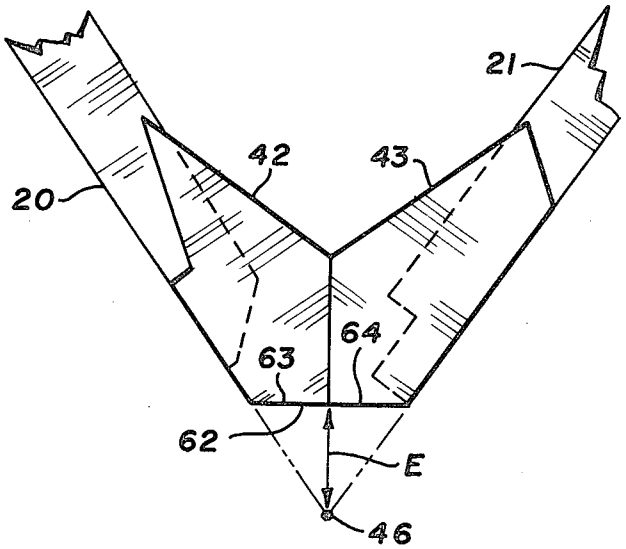
FIG. 11 is a view similar to FIG. 10, but with the tip plates being adjustably positioned so as to position the projected apex point at a distance further removed from the tip ends of the convergent arms, thereby forming a gusset in the web of a dimension greater than that of FIG. 10.
Figure 13:
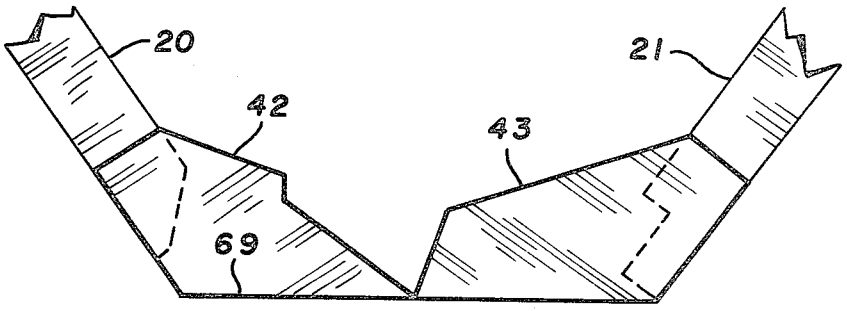
Figure 12:
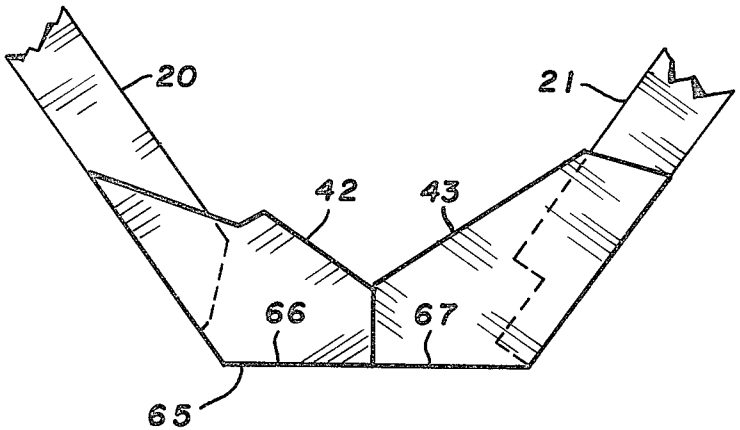
Figure 9:
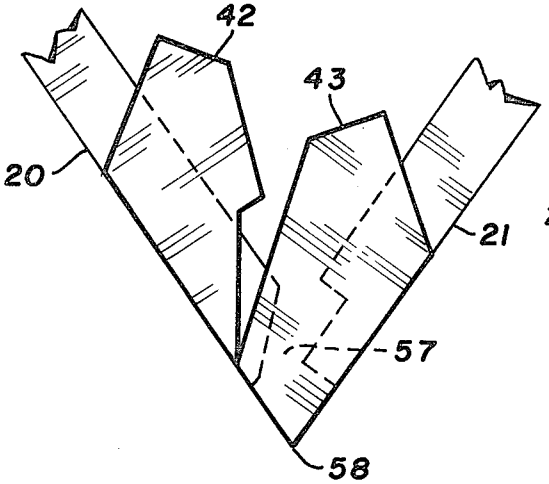
FIG. 9 is an elevational view of a pair of mutually convergent arm members having tip plates secured thereto, with the tip plates being disposed so as to form a fold in the web, without gussets.

FIG. 12 is a veiw similar to FIG. 11, but with tip plates being disposed so as to position the projected apex point at a distance further removed from the tip ends of the convergent arms, thereby forming a gusset in the web which is larger than that provided in the disposition of FIG. 11; and FIG. 13 is a view similar to FIG. 12, but with tip plates being arranged and positioned so as to position the projected apex point at a distance further removed from the tip ends of the convergent arms, thereby forming a gusset in the film which is larger than that formed in the configuration of FIG. 12.

DESCRIPTION OF THE PREFERRED EMBODIMENT

Figure 1:
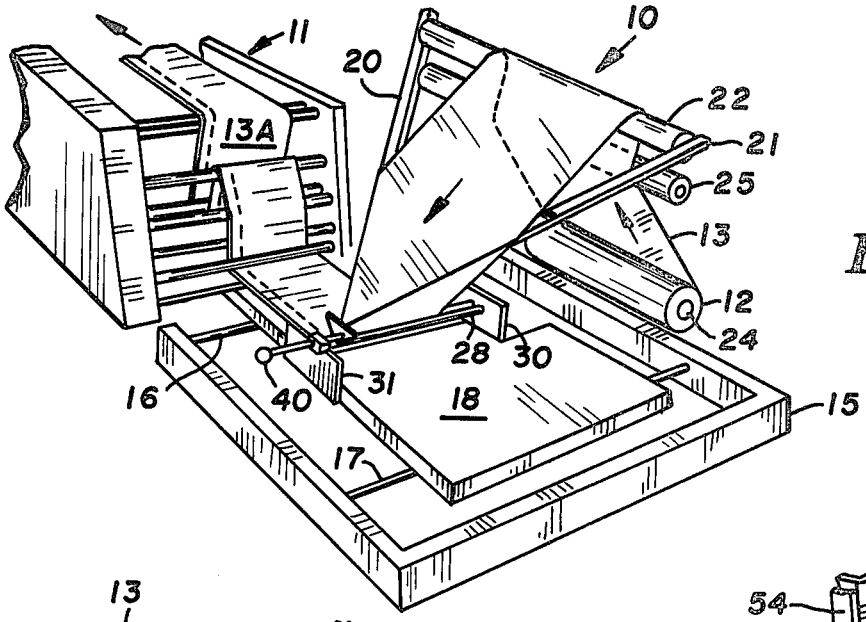

In accordance with the preferred embodiment of the present invention, and with particular attention being directed to FIG. 1, the sheet folding means generally designated 10 is positioned in combination with a conventional converting machine, such as a bag making machine 11 operating with a supply roll 12 providing the working film web 13. Folder 10 is secured upon frame 15, with the frame 15 including transverse mounting shafts 16 and 17 upon which base pad 18 may be adjustably positioned. The sheet folder 10 includes a triangular frame structure made up of mutually converging arms 20 and 21, which converge toward an apex, where indicated, and with the spaced apart ends being secured together through a trapezoidal support frame, one leg of which includes the shaft or axis of idler roll 22. Supply roll 12 from which web 13 is drawn is preferably mounted upon a spiral shaft such as at 24, with web 13 then extending across idler 25 and ultimately across idler roll 22 and onto folder 10. Upon passing over from folder 10, web 13 is converted to a gusseted web, which for purposes of simplicity is identified as 13*a*. The phantom line present in web 13*a*is intended to illustrate the gusset formed at the fold-over line of the web.

Figure 2:
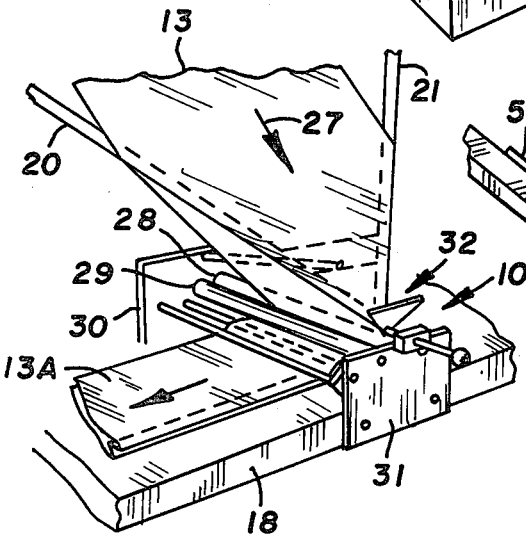
FIG. 2 is a detail perspective view, with portions being broken away, and illustrating the details of the sheet folder device adjacent the folding apex tip thereof.
Figure 4:
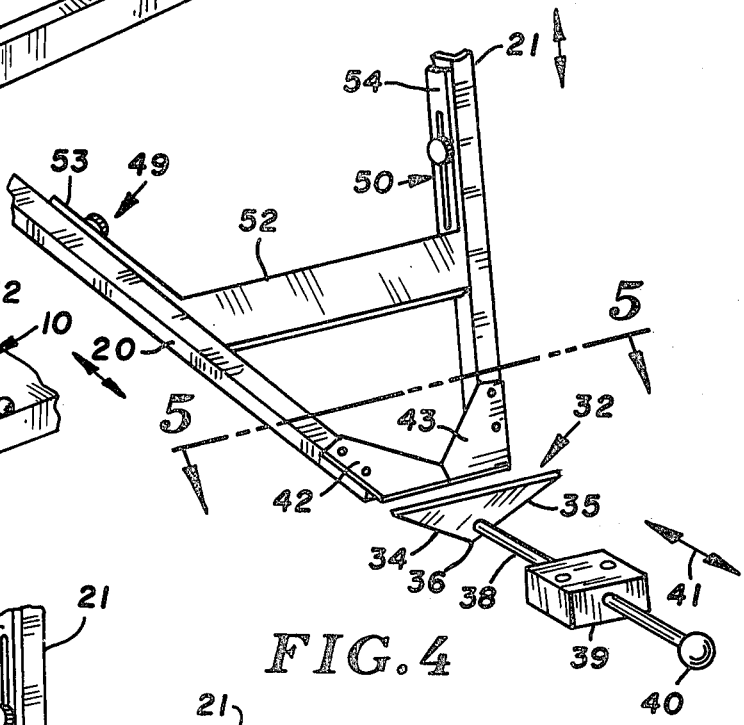
FIG. 4 is a detail perspective view, similar to FIG. 3, and illustrating the details of the motion available between the components, and with a gusset forming member being disposed adjacent the tips of the convergent arm member.

With attention now being directed to FIG. 2 of the drawings, it will be observed that web 13, passing along and in the direction of arrow 27 passes across the edges of converging arms 20 and 21, thereby providing a folding station. Upon leaving the working zone of folder 10, the folded web which is represented by 13*a*is passed through the nip of creasing rolls 28 and 29, thereby encouraging the web 13 to lie in a generally flat planar condition as it passes through and along the various stations of converter machine or apparatus 11. Suitable means are provided for journaling rolls 28 and 29, with these rollers being, in turn, supported on lateral plates 30 and 31.

Figure 3:
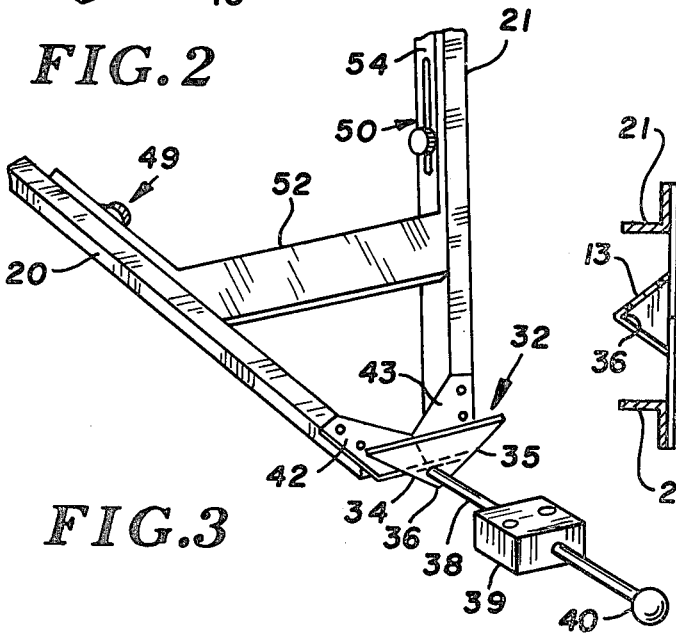
FIG. 3 is a view similar to FIG. 2, but with the film removed therefrom for purposes of exposing additional detail of the apparatus.
Figure 5:
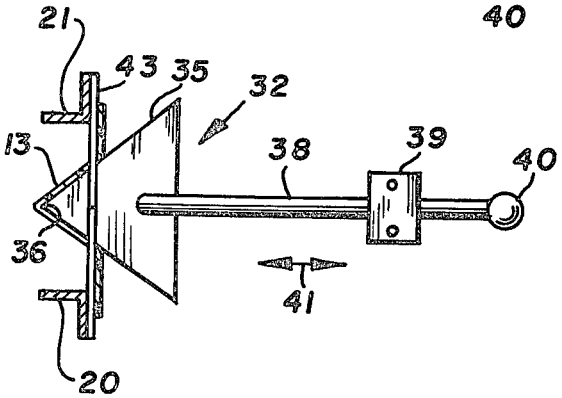
FIG. 5 is a detail sectional view taken along the line and in the direction of the arrows 5—5 of FIG. 4, and illustrating the manner in which a gusset is formed in a traveling web of film.
Figure 6:
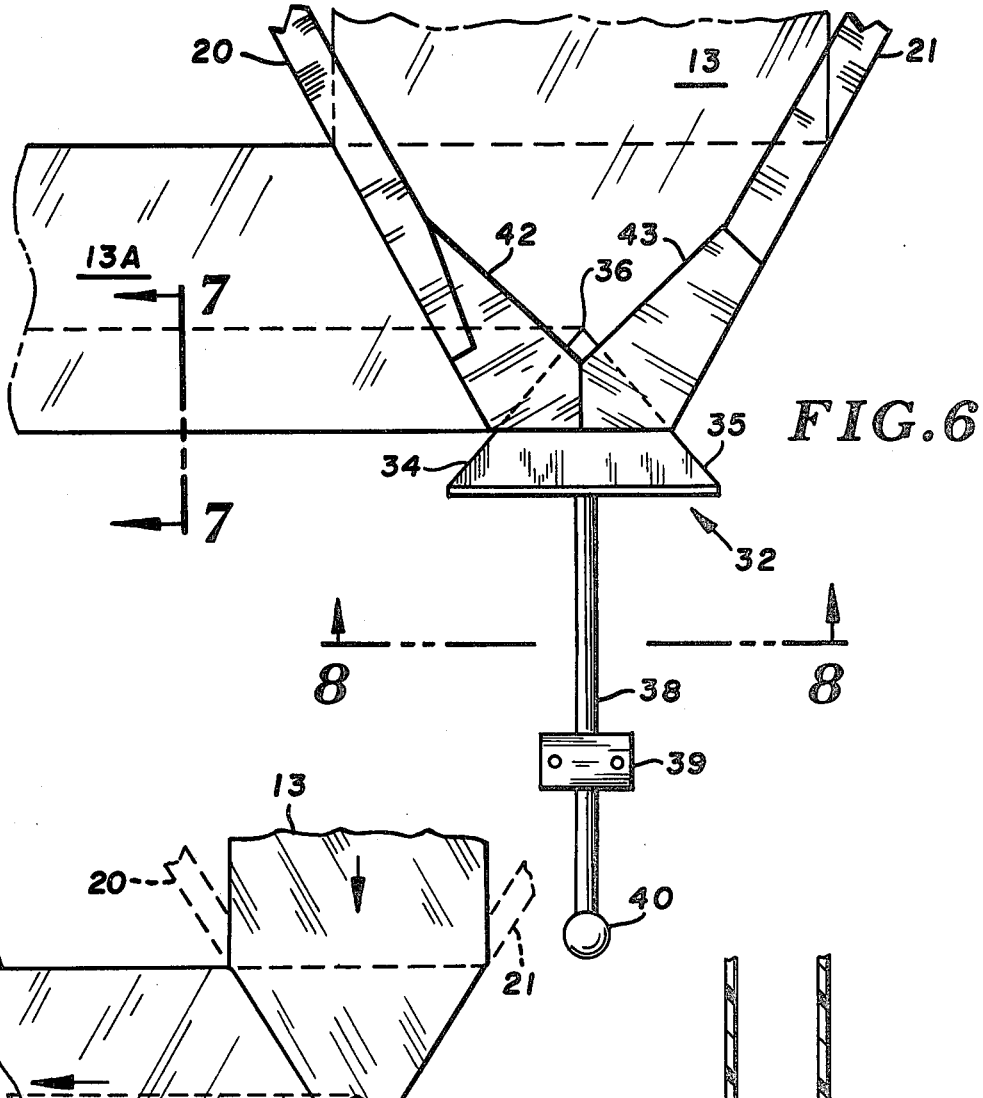
FIG. 6 is a top plan view of the sheet folder of the present invention, and illustrating the manner in which a web of film passes across the apex thereof.
Figure 8:
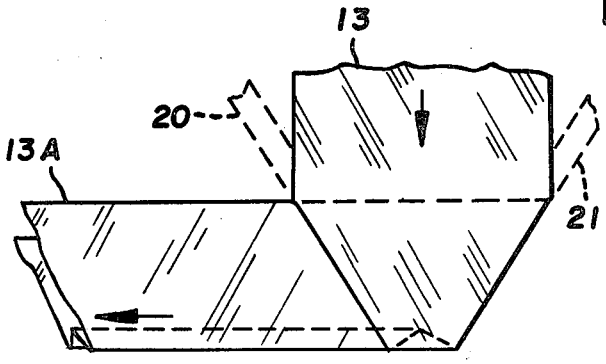
FIG. 8 is a sectional view taken along the line and in the direction of the arrows 8—8 of FIG. 6, and illustrating the formation of a gusset in the traveling film web.
Figure 7:
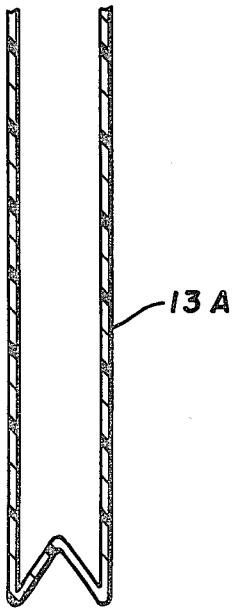
FIG. 7 is a sectional view taken along the line and in the direction of the arrows 7—7 of FIG. 6, and illustrating the detail of a gusset formed in a traveling web of film.

As can be seen in FIG. 2 and 3, a gusset forming member generally designated 32 is positioned in the working area of the folder. Gusset forming member 32 is provided with a pair of converging edge surfaces 34 and 35 which form an apex as at 36. Gusset forming member 32 is secured to mounting rod 38, which, in turn, is arranged to be adjustably positioned within block member 39. For purposes of simplicity, an adjusting handle or knob is provided and is fast on rod 38, and is shown at 40. Double-headed arrrow 41 illustrates the motion possible with gusset forming member 32.

Attention is now directed to FIG. 3–6 of the drawings wherein the details of the tip plates are shown. Specifically, first and second tip plates 42 and 43 are shown, with tip plates 42 and 43 being, in turn, secured to the free ends of mutually convergent arm members 20 and 21, respectively. It will be observed that each of the tip plates is in the form of a polygon with linear edges. Each of the linear edges is dimensioned so as to permit the tip plates to span the space between the converging arm members at the tips of the members 20 and 21 so as to form a projected apex position. This position is projected outwardly from the ends of the converging arm means, as is illustrated for purposes of simplicity at imaginary or projected apex points 45 (FIG. 10) and 46 (FIG.11).

In order to provide the desired apex point, arms 20 and 21 are adjustably positioned with respect to each other by means of adjustment slots and screws shown generally at 49 and 50. Generally, slots will be formed in the converging arms so as to permit these arms to be moved axially toward and away from the imaginary or apex point. A trapezoidal transverse frame support which is preferably mounted on the base frame which includes cross-member 52 along with shaft 22 is provided, as desired, in order to provide stability. Member 52, as indicated, preferably spans the area separating slotted plates 53 and 54 of the adjustment slots and screws 49 and 50 respectively. Therefore, adjustment and securing of the assembly including converging arms 20 and 21 relative to members 52,53, and 54 will determine the position of the projected apex.

Attention is now directed to FIGS. 9–13 of the drawings, wherein the individual dispositions of the tip plates 42 and 43 are illustrated. With attention being specifically directed to FIG. 9, it will be observed that tip plate 43 is positioned so as to occupy the span or gap area as at 57. In this instance, the projected apex of arms 20 and 21 coincides with the apex point 58 of tip plate 43. In this disposition, a web passing over the folder device will be folded, without any gusset being formed.

Figure 10:
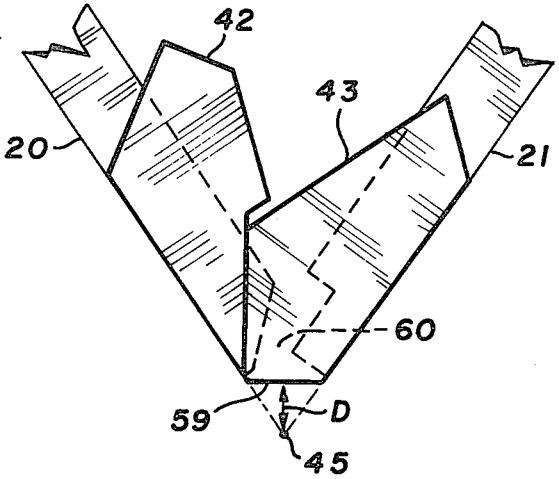
FIG. 10 is a view similar to FIG. 9, but with tip plates being disposed so as to position the projected apex point at a distance further removed from the tip ends of the convergent arms, thereby forming a small gusset in the web.

Attention is now directed to FIG. 10 of the drawings wherein the tip plates 42 and 43 have been mounted in a somewhat different disposition. Specifically, tip plate 43 has been changed from its disposition of FIG. 9 so that the lateral edge surface 59 of plate 43 forms a closed end across the gap area 60 between arms 20 and 21. It will be observed in FIG. 10 that the apex point 45 is that certain projected apex point which is the result of projections of the edge surfaces of arms 20 and 21. The point of the apex is disposed outwardly from edge 59 by a distance or dimension shown at D. In forming a gusset, gusset forming member 32 will be positioned so that the apex point 36 thereof will be disposed in that gap zone defined by the dimension D, thereby permitting the formation of a conventional gusset in the traveling web.

Attention is now directed to FIG. 11 of the drawings wherein the plate 42 has been mounted in a different disposition, thereby forming a combined edge surface as at 62. Edge surface 62 is comprised of segments 63 and 64, with segments 63 and 64 being, in turn formed from the linear edge surface of tip plates 42 and 43 respectively. As is apparent in FIG. 11, projected apex 46 is disposed at a distance further from the ends of members 20 and 21, with the distance being defined by the dimension E.

Attention is now directed to FIG. 12 of the drawings wherein a further repositioning of tip plate 42 is illustrated. In this disposition, plates 42 and 43 are arranged so that a combined edge surface 65 is formed, with surface 65 comprising edges 66 and 67 of tip plates 42 and 43 respectively. In this disposition, the projected apex is, of course, further removed from the arms 20 and 21 as compared to the arrangements of FIGS. 10 and 11. Attention is now directed to FIG. 13 of the drawings wherein a still further rearrangement of tip plate 42 relative to plate 43 is illustrated. In this arrangement, the edge 69 is provided which is, of course, a larger dimension than that provided in the arrangements of FIGS. 10–12, inclusive, and will, of course, project the apex of the arms 20 and 21 at a distance still further removed. In the dispositions of FIGS. 11,12, and 13, tip plates 42 may be selectively overlapped to provide added versatility along with a continuous linear surface.

If desired, a thin film of polytetrafluoroethylene may be applied to those surfaces of a device across which the web travels. This reduces the friction and has been found to increase or enhance the quality of the folds.

I claim:

1. Sheet folding means comprising a triangular frame structure having an apex over which a web of sheet material is passed forming folds therein and including:

(a) frame means, first and second mutually convergent arm member secured to said frames and converging toward an apex adjacent the tip ends thereof, and with the respective tip ends normally being spaced apart to form a lateral gap therebetween;

(b) first and second tip plates adapted for mounting upon said first and second mutually converging arm members respectively;

(c) said first and second tip plates each being polygons with linear edges, the dimensions of said linear edges being selected so as to span the space between said convergent arm members at the tips of said convergent arm members to form a selected apex point, the arrangement being such that the apex point is disposed generally at a predetermined location projected outwardly from the ends of said convergent arm members; and (d) a gusset forming member being provided, said gusset forming member having a pair of convergent edge surfaces forming an apex, and with said gusset forming member being secured to said frame means and adjustably disposed with the apex of said gusset forming member positioned generally within the lateral gap between said projected apex and the linear edges of said tip plates.

2. Sheet folding means comprising a triangular frame structure having an apex over which a web of sheet material is passed forming folds therein and including:

(a) frame means, first and second mutually convergent arm members secured to said frames and converging toward an apex adjacent the tip end thereof, and with the respective tip ends normally being spaced apart to form a lateral gap therebetween;

(b) first and second tip plates adapted for mounting upon said first and second mutually converging arm members respectively;

(c) said first and second tip plates each being polygons with linear edges, the dimensions of said linear edges being selected so as to span the space between said convergent arm members at the tips of said convergent arm members to form a selected apex point, the arrangement being such that the apex point is disposed generally at a predetermined location projected outwardly from the ends of said convergent arm members; and (d) means are provided for selectively rotating said first and second tip plates so as to provide selected dimensions of the linear edges thereof, the arrangement being such that said tip plates form a linear edge of a certain first dimension while in a first relative disposition, and form a linear edge of a certain second dimension while in a second relative disposition, each of said linear edges being normal to a plane bisecting the angle of convergence formed by said arm members.

3. The sheet folding means as defined in claim 2 being particularly characterized in that the film contacting surfaces of said sheet folding means are coated with a low friction film.

4. The sheet folding means as defined in claim 3 being particularly characterized in that the film contacting surfaces of said sheet folding means are coated with a film of polytetrafluoroethylene.

* * * * *